US006308137B1

(12) United States Patent
Underhill et al.

(10) Patent No.: US 6,308,137 B1
(45) Date of Patent: Oct. 23, 2001

(54) METHOD AND APPARATUS FOR COMMUNICATION WITH A DOWNHOLE TOOL

(75) Inventors: William B. Underhill; Cengiz Esmersoy; Brian Clark, all of Sugar Land; Jean-Michel Hache, Houston, all of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/514,866

(22) Filed: Feb. 28, 2000

Related U.S. Application Data

(63) Continuation-in-part of application No. 09/429,804, filed on Oct. 29, 1999, now abandoned.

(51) Int. Cl.[7] ..... G01V 1/50
(52) U.S. Cl. ..... 702/9
(58) Field of Search ..... 702/9, 6–8, 14, 702/17; 367/76, 79

(56) References Cited

U.S. PATENT DOCUMENTS

| | | | | |
|---|---|---|---|---|
| 4,281,403 | * | 7/1981 | Siems et al. | 367/76 |
| 4,561,074 | * | 12/1985 | Warmack | 702/17 |
| 5,065,825 | | 11/1991 | Bardin et al. . | |
| 5,084,844 | * | 1/1992 | Wang | 702/14 |
| 5,157,392 | * | 10/1992 | Zimmer | 702/6 |
| 5,253,219 | * | 10/1993 | Houston et al. | 367/79 |
| 5,555,220 | | 9/1996 | Minto . | |
| 5,579,283 | | 11/1996 | Owens et al. . | |
| 5,585,556 | | 12/1996 | Petersen et al. . | |
| 5,955,966 | | 9/1999 | Jeffryes et al. . | |
| 6,078,868 | | 6/2000 | Dubinsky . | |

FOREIGN PATENT DOCUMENTS

| | | |
|---|---|---|
| 2 334 982 A | 9/1999 | (GB) . |
| WO 00/13043 | 3/2000 | (WO) . |
| WO 00/33492 | 6/2000 | (WO) . |

* cited by examiner

*Primary Examiner*—Donald E. McElheny, Jr.
(74) *Attorney, Agent, or Firm*—John J. Ryberg; Victor H. Segura

(57) ABSTRACT

An apparatus for communication with a downhole tool includes uphole and downhole equipment. The uphole equipment includes a signal source (or array) coupled to a programmable triggering system and a precision clock. Optionally, the uphole equipment may include receivers for capturing reference signals near the source and may include telemetry equipment for receiving MWD signals from the downhole equipment. The downhole equipment includes one or more receivers, signal processing equipment, memory, and a precision clock. Optionally, the downhole equipment also includes MWD telemetry equipment for transmitting data to the surface. The methods of the invention include, but are not limited to, synchronizing the recordation of signals detected downhole with the firing of the signal source and processing the recorded signals to eliminate useless information. The methods of the invention present several techniques for true source signal recognition whereby actual signal information is extracted from the recordings of the receivers so that the ultimate stored data is compact and virtually 100% useful. This elimination of useless data conserves valuable telemetry time and/or enables longer operation of the apparatus before tripping out to retrieve stored data by using memory efficiently.

55 Claims, 6 Drawing Sheets

METHOD AND APPARATUS FOR COMMUNICATION WITH A DOWNHOLE TOOL

CROSS-REFERENCES

This present application is a continuation-in-part of U.S. application Ser. No. 09/429,804 filed on Oct. 29, 1999, hereby abandoned without prejudice.

BACKGROUND OF THE INVENTION

1. Field of the Invention

The invention relates to oil and gas exploration/production. More particularly, the invention relates to a method and apparatus for improved communication techniques between an uphole apparatus and a downhole tool.

2. State of the Art

Logging-while-drilling (LWD) or measurement-while-drilling (MWD) involves the transmission to the earth's surface of downhole measurements taken during drilling. The measurements are generally taken by instruments mounted within drill collars above the drill bit in order to obtain information such as the position of the bit, oil/gas composition/quality, pressure, temperature and other geophysical and geological conditions. Indications of the measurements must then be transmitted uphole to the earth's surface. It has been one longstanding objective to develop data transmission systems which do not require the utilization of electrical conductors. The utilization of electrical conductors has several serious disadvantages including: (1) since most wellbores include regions which are exposed to corrosive fluids and high temperatures, a long service life cannot be expected from a data transmission system which utilizes electrical conductors; (2) since most wellbores extend for substantial distances, data transmission systems which utilize electrical conductors are not generally considered to be cost effective, particularly when such systems are utilized only infrequently, or in a limited manner; (3) since all wellbores define fairly tight operating clearances, utilization of a wireline conductor to transmit data may reduce or diminish the operating clearance through which other wellbore operations are performed; and (4) since wellbores typically utilize a plurality of threaded tubular members to make up tubular strings, utilization of an electrical conductor to transmit data within the wellbore complicates the make-up and break-up of the tubular string during conventional operations.

Accordingly, the oil and gas industry has moved away from the utilization of electrical conductor data transmission systems (frequently referred to as "hardwire" or "wireline" systems), and toward the utilization of wireless systems to transmit data within the wellbore. The most common scheme for transmitting measurement information utilizes the drilling fluid within the borehole as a transmission medium for acoustic waves modulated to represent the measurement information. Typically, drilling fluid or "mud" is circulated downward through the drill string and drill bit and upward through the annulus defined by the portion of the borehole surrounding the drill string. The drilling fluid not only removes drill cuttings and maintains a desired hydrostatic pressure in the borehole, but cools the drill bit. In a species of the technique referred to above, a downhole acoustic transmitter known as a rotary valve or "mud siren", repeatedly interrupts the flow of the drilling fluid, and this causes a varying pressure wave to be generated in the drilling fluid at a frequency that is proportional to the rate of interruption. Logging data is transmitted by modulating the acoustic carrier as a function of the downhole measured data.

One type of MWD technique called Vertical Seismic Profiling (VSP) involves the use of a seismic source and sensors, together with a memory and calculation device for storing and processing the received seismic signals. U.S. Pat. No. 5,585,556 describes a method and apparatus for performing VSP-measurements where the seismic source is placed at or in the vicinity of the surface of the earth (or water). Signals generated by the source are detected by hydrophones or geophones located in the vicinity of the source at the surface and in the drill string. The geophones or the hydrophones in the drill string transmit the detected signals to a memory and calculation unit in the drill string that processes and transmits the signals completely or partly to a central data processing unit on the rig. The hydrophones or the geophones at the surface simultaneously transmit the detected signals to the central data processing unit at the surface, while chronometers showing identical times, connected to the source and to the memory and calculation device in the drill string make possible a precise calculation of the travel time of the seismic signal between the source and the geophones or the hydrophones in the drill string.

According to the preferred embodiment of the '556 patent, circulation of the drilling fluid is interrupted as the sensors in the drill string are activated for the registration of sound signals discharged from the seismic source. In the following 60–120 seconds the memory and calculation unit will acquire all signals from the sensors in the drill string. The signals contain both the transmitted and the reflected waveforms. The sources must be discharged within a fixed interval of time. After this time interval, the content of the memory unit is copied to the calculation unit and is processed to determine the number of shots, the mean arrival time, and the mean amplitude of the first arrived signals. This information may be returned to the surface using MWD telemetry while the drilling fluid is put into circulation again. Alternatively, the information may be stored in memory and retrieved when the tool is tripped out of the borehole.

A disadvantage of the method disclosed by the '556 patent is that there is no disclosed method of communicating with the downhole tool to indicate to the downhole tool that VSP shots are commencing. Since the downhole data acquisition is non-discriminatory when circulation is stopped, i.e., most of the data recorded does not include useful signal information; the downhole tool continuously receives and stores acoustic waveforms without any disclosed discrimination. Since MWD telemetry has a very small bandwidth, e.g., one bit per second, transmission of useless information can delay the transmission of valuable data from other LWD tools. Ultimately, time is wasted and since the cost of rig time, particularly offshore rig time, is extremely expensive, time is of the essence when acquiring downhole measurement information. Moreover, while it is possible to store all of the acquired data in downhole memory, most of the memory will be wasted and the tool will need to be withdrawn more frequently than desired.

U.S. Pat. No. 5,579,283 describes a method and apparatus for communicating coded messages in a well bore. The method uses transmitting and receiving apparatus that are in contact with the well bore fluid to send coded pressure pulses to downhole tools. A disadvantage of the method described by the '283 patent is that the communication technique alters the operating state of the downhole tool.

Thus, there remains a need for a technique to communicate with a downhole tool in an efficient manner that discriminates between signal data, representative of a true signal originating from a selected signal source, and useless data.

SUMMARY OF THE INVENTION

It is therefore an object of the invention to provide methods and apparatus for improved communication with a downhole tool from a signal source located uphole or at a remote location.

It is also an object of the invention to provide methods and apparatus for acquiring signal data in a downhole tool which discriminates between data representative of a true source signal and useless data.

It is another object of the invention to provide methods for making VSP measurements which are better and more time efficient than the prior methods.

It is still another object of the invention to provide methods for instructing a downhole tool to perform a specific action or process by means of effective communication.

In accord with these objects which will be discussed in detail below, the apparatus of the present invention includes uphole and downhole equipment. The uphole equipment includes a signal source, such as a seismic source, (or array) coupled to a programmable triggering or firing system and a clock. Optionally, the uphole equipment may include receivers (such as acoustic receivers) for capturing reference signals near the source and may include telemetry equipment for receiving MWD signals from the downhole equipment. The downhole equipment includes one or more receivers, preferably acoustic receivers, signal processing equipment, memory, and a clock. Optionally, the downhole equipment may also include other sensors such as flow sensors and motion sensors, as well as MWD telemetry equipment for transmitting data to the surface.

The communication methods of the present invention include the initiation of an uphole signal that will be recognized by the downhole tool. Once the signal is recognized, the downhole tool then performs a specific action or process in response. The invention includes, but is not limited to, tightly synchronizing the recordation of signals detected downhole with the firing of the signal source (on the surface or at a remote location) and processing the recorded signal data to eliminate useless information. Downhole recording of signal data may be continuous or individual time records may be captured according to a schedule that is associated with the schedule of possible source activation.

According to one aspect of the invention, it is assumed that no signal data measurements will be made while drilling, while drill pipe is moving, or while mud is circulating. According to this aspect, downhole flow sensors and motion sensors enable the signal processing equipment to determine when signal data representative of true signals originating from the source are to be recorded. When the downhole flow sensors and motion sensors indicate that drilling has stopped and the circulation of mud flow has been interrupted, the signal processing equipment will begin to acquire signal data received from the receivers. However, since it cannot be assumed that signal measurements will be performed every time drilling is stopped and mud circulation is interrupted, the invention provides additional means to communicate with the downhole tool that signal measurements are intended to be made.

The methods of the invention present several algorithms for true source signal recognition, whereby actual signal data information is extracted from the recordings of the receivers so that the ultimate stored data is compact and virtually 100% useful. This elimination of useless data conserves valuable telemetry time and/or enables longer operation of the apparatus before tripping out to retrieve stored data.

According to the methods of the invention, sequentially recorded signal data from the receivers are compared to each other to determine whether they "look similar." Sequentially recorded signal data may be derived by extracting record samples from a moving time window on a continuous recording, or by capturing individual time records according to a schedule that is synchronized with a schedule of possible source activation. It is not necessary to have a catalogue of "useful" or "useless" signal data downhole because sequentially recorded signal data can be made to intentionally look similar with repeated activation of the surface source according to a predetermined schedule that is known to the downhole tool.

According to another aspect of the invention, similarity measurements are further processed to give values between 0 and 1 (a first probability) and a probabilistic analysis is utilized to determine whether a record represents a true source signal.

According to another aspect of the invention, record selection is enhanced by breaking each record into multiple time windows. Each record is preferably broken into two time windows, one of which contains noise and the other of which may contain a true source signal. This is implemented by tightly synchronizing the downhole and surface clocks for accurate partitioning of the downhole recordings. The "energy" contained in each window is calculated and the energies are combined in such a way that a second signal probability is obtained. The first probability and second probability are multiplied to obtain a third probability which is used to determine the presence or absence of a true signal.

Additional objects and advantages of the invention will become apparent to those skilled in the art upon reference to the detailed description taken in conjunction with the provided figures.

DETAILED DESCRIPTION OF SPECIFIC EMBODIMENTS

Figure 2:
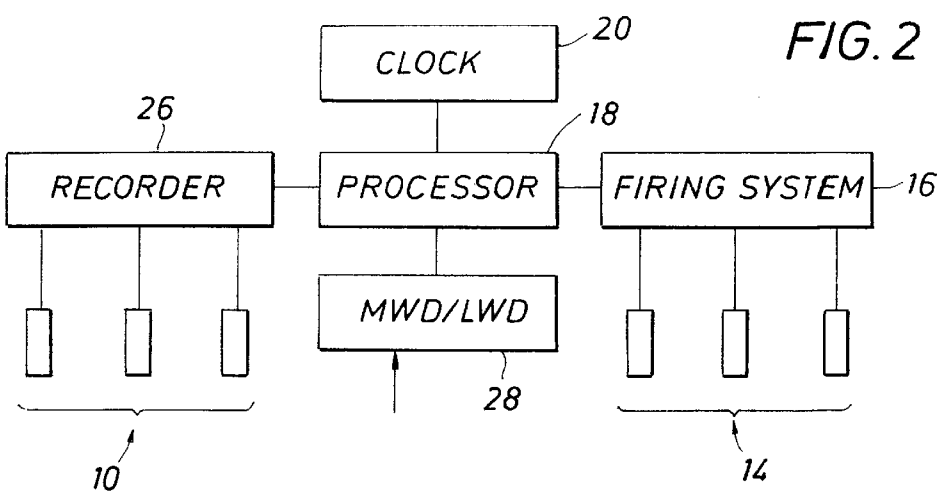
FIG. 2 is a simplified block diagram of the surface equipment of the apparatus of the invention.
Figure 3:
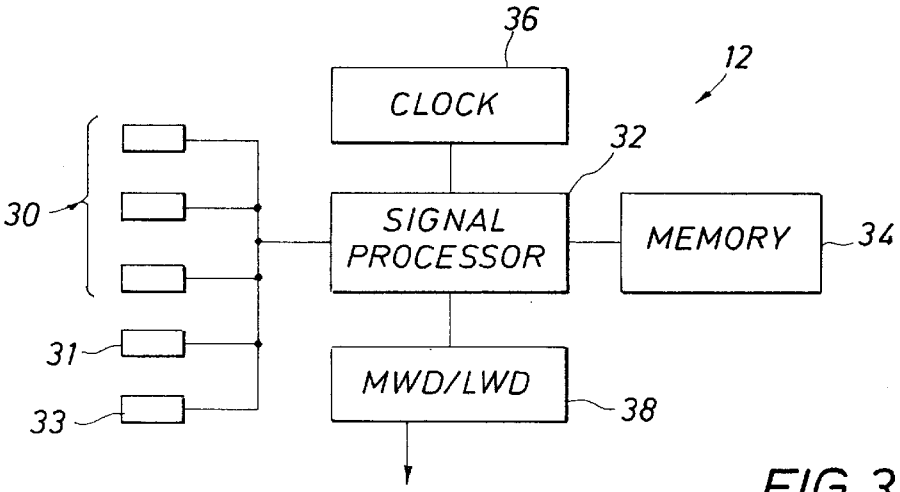
FIG. 3 is a simplified block diagram of the downhole equipment of the apparatus of the invention.
Figure 1:
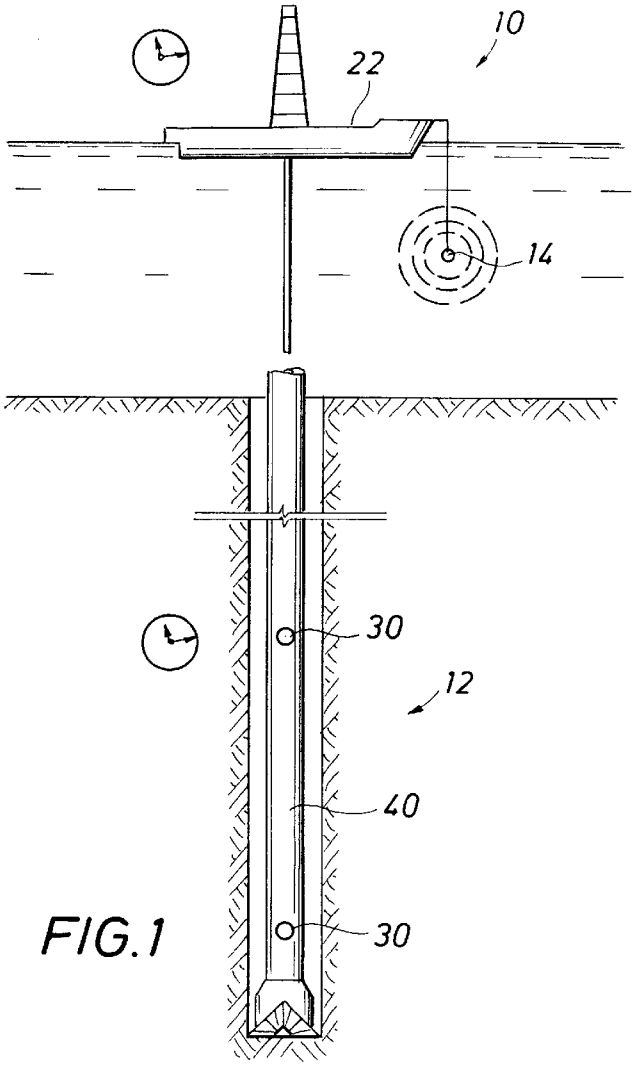
FIG. 1 is a schematic illustration of an exemplary offshore installation incorporating the invention.

Referring now to FIGS. 1 through 3, an apparatus of the invention includes uphole equipment 10 and downhole equipment 12. The uphole equipment includes a signal source (or array) 14 coupled to a firing system 16, a programmable processor 18, and a clock 20 coupled to the processor. One embodiment of the invention comprises a seismic signal source 14. In the illustration of FIG. 1, the firing system, processor, and clock are located on an off shore rig 22 and the seismic array 14 is deployed near the rig, close to the surface of the water. Preferably, the uphole equipment 10 also includes acoustic receivers 24 and a recorder 26 for capturing reference signals near the source. The uphole equipment 10 further preferably includes telemetry equipment 28 for receiving MWD signals from the downhole equipment. The telemetry equipment 28 and the recorder 26 are preferably coupled to the processor 18 so that recordings may be synchronized using the clock 20.

The downhole equipment 12 includes one or more receivers 30, signal processing equipment 32, memory 34, and a clock 36. One embodiment of the invention comprises acoustic receivers 30. The receivers 30, clock 36 and memory 34 are coupled to the signal processor 32 so that recordings may be made of signals detected by the receivers in synchronization with the firing of the signal source 14. Preferably, the downhole equipment 12 also includes a motion sensor 31, a mud flow sensor 33, and MWD telemetry equipment 38 for transmitting data to the uphole equipment 10. As illustrated in FIG. 1, the downhole equipment 12 is housed in a downhole tool 40 forming part of a drill string, which is shown traversing a borehole beneath the ocean bed. The clocks 20 and 36 are preferably accurate enough so that they remain within a few milliseconds of each other so long as the apparatus is in operation.

The communication techniques of the invention include identifying the signal data (such as acoustic waveforms) detected downhole with the firing of the signal source 14 and processing the waveforms to eliminate useless information. This is accomplished by segmenting the detected signal data into time windows or traces of finite duration and comparing the data. In other words, the detected signal data is partitioned or broken into specific events defined by a specific time period. Although the length of the period may be varied, each trace is preferably defined by an equal time period associated with the firing schedule of the signal source 14.

The processor 18 is programmed to cause the firing system 16 to activate the signal source 14 according to a schedule that is known to the downhole equipment 12. For example, as described below with reference to FIG. 4, the firing system 16 will consecutively activate the signal source 14 sixteen times with a fifteen second pause between each firing and then not again until the downhole system has been moved to a different depth. The downhole system acquires data periodically with three-second recordings scheduled fifteen seconds apart. Each acquisition is, therefore, at a predefined time when there is a possibility for source 14 activation to occur.

The methods of the invention also include several algorithms for signal recognition whereby true signal information is extracted from the recordings of the receivers 30 so that the ultimate stored data is compact and virtually 100% useful. This elimination of useless data conserves valuable telemetry time and/or enables longer operation of the apparatus before tripping out to retrieve stored data by using memory efficiently. As mentioned above, and depending on the accuracy of the signal recognition algorithm, it may be preferable to perform signal processing only when the motion and flow sensors indicate that drilling has stopped and the mud flow has been interrupted.

Figure 5:
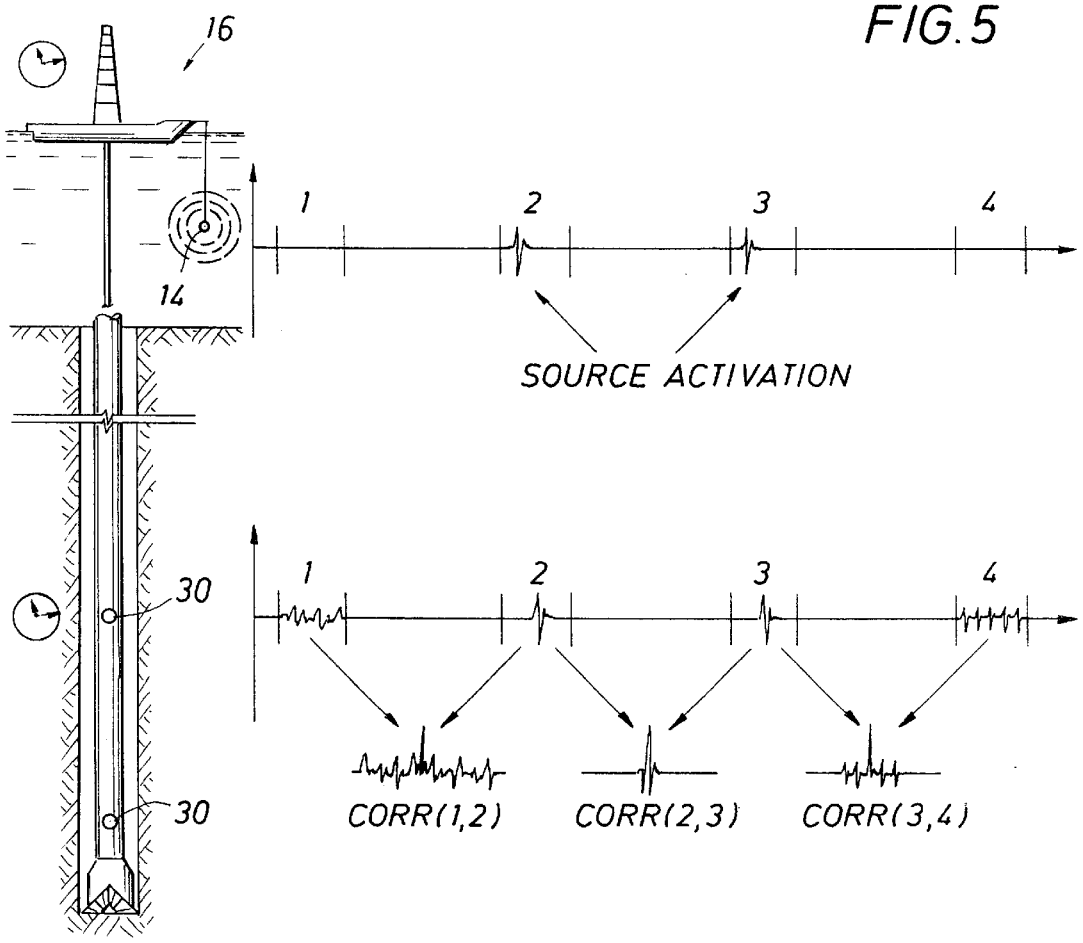
FIG. 5 is a schematic diagram of a signal data correlation technique according to the invention.

FIG. 5 illustrates a true signal recognition technique of the invention. A correlation algorithm is used to compare sequentially recorded signal data from the receivers 30. Each recorded trace (1, 2, 3, 4 . . . ) is a time interval, e.g., three seconds, which is synchronized to the schedule of the uphole firing system 16 so that if a signal is being generated, it will be captured in a recording. Accurate synchronization is only necessary if absolute timing information is needed. Otherwise, basic communication may be achieved by simply segmenting a continuous recording into consecutive time windows with duration equal to the period of source 14 activation. Preferably, the first sample of a segmented trace should immediately follow the last sample of the previous trace. Correlation concepts are further described in A. V. Oppenheim and R. W. Schafer, Digital Signal Processing 556 Prentice-Hall 1975.

The basic correlation technique is to correlate signal data from sequentially recorded traces, for example traces ("x") and ("y"). The first trace x can be a stack or average of accumulated signal data waveforms which have been determined to have true signal content (by the iterative techniques of the invention described below) prior to the accumulation of trace y. For the case where there are only two traces x and y, the method accepts x as a single recorded trace and also reverts to this case after a trace with no true signal content has been recorded. Additionally, the traces x, y are taken as inputs to coherence and signal-noise decomposition schemes. In the following, the traces x, y are written as $x_i$ and $y_i$, where i is a time index.

For N samples of traces x, y, the correlation is calculated as shown in equation (1) below.

$$C_{xy}(m) = \sum_{n=0}^{N-|m|-1} x_{n+1} y_{n+m+1} \tag{1}$$

Figure 6:
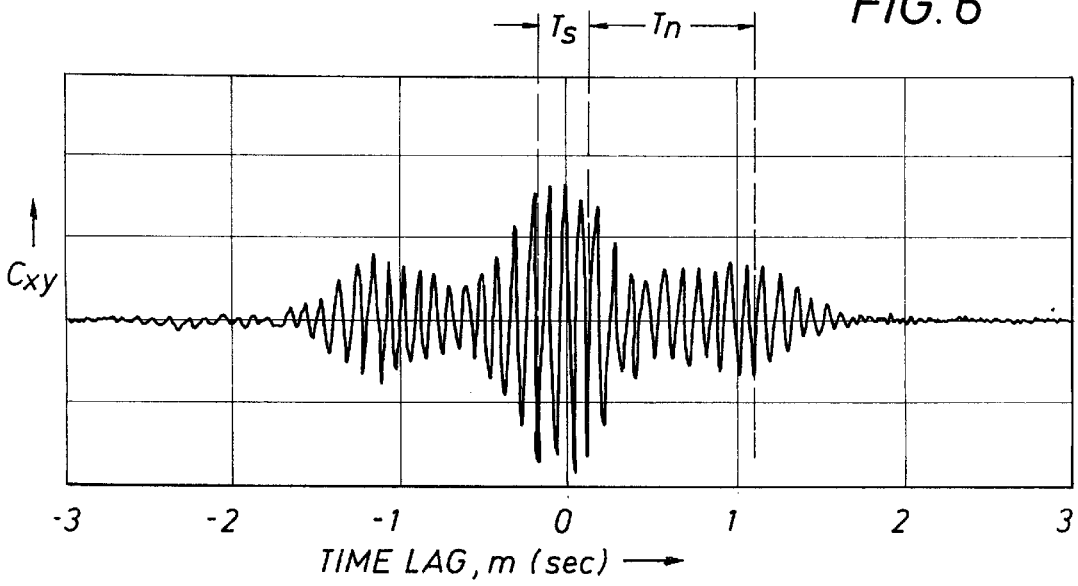
FIG. 6 is an example of correlated signal data according to the invention.

Applying this equation to a set of recordings obtained from the receivers 30 downhole yields a waveform of the type shown in FIG. 6. The correlation waveform illustrated in FIG. 6 shows a true signal portion in the time window $T_s$ and a noise portion in the time window $T_n$. The likelihood of true source signal content being present in the $T_s$ time window is measured by calculating the ratio of root-mean-square (RMS) amplitude within the two windows as shown in equation (2) below and expressing it as a probability P.

$$P = \frac{\frac{1}{T_s}\sum_{T_s} C_{xy}^2}{\frac{1}{T_n}\sum_{T_n} C_{xy}^2} \tag{2}$$

The probability P is compared to a predetermined threshold to determine if source 14 activation has occurred. If the probability exceeds the threshold value, the downhole processor 32 can take appropriate action, and basic communication has been achieved.

According to another aspect of the invention, the traces x, y from the sequentially recorded signal data are analyzed for "coherence", a known measure of similarity. Coherence analysis is further described in S. L. Marple Jr., Digital Spectral Analysis with Applications 390 Prentice-Hall 1987. The coherence function is shown below as equation (3) where $P_{xy}$ is the power spectral density (as known to those skilled in the art), and f is frequency. The coherence function is calculated for every frequency and returns a value between 0 and 1, indicating how well the input x corresponds to the input y at each frequency.

$$Co_{xy}(f) = \frac{|P_{xy}(f)|^2}{P_{xx}(f)P_{yy}(f)} \tag{3}$$

Figure 7:
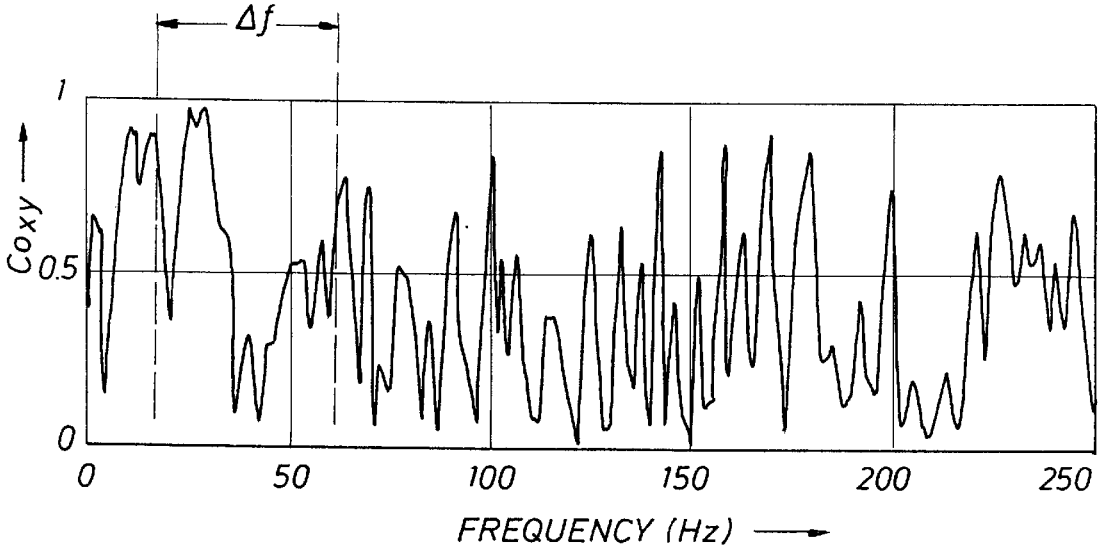
FIG. 7 is an example of the output of a coherence calculation according to the invention.

FIG. 7 illustrates a typical coherence function. As the function varies between 0 and 1, it can be used to determine the probability of true signal content in a recording. The probability that sequential recordings contain a true signal rather than noise is calculated according to equation (4) below, which is an average of the coherence function within a frequency band Δf.

$$P = \frac{1}{\Delta f}\sum_{\Delta f} Co_{xy}(f) \tag{4}$$

The frequency band Δf is chosen according to known characteristics of the particular signal being generated from the signal source 14, e.g., seismic signal characteristics. As in the correlation technique of the invention, the probability P is compared to a predetermined threshold to determine if source 14 activation has occurred. If the probability P exceeds the threshold value, the downhole processor 32 can take appropriate action, and basic communication has been achieved.

Figure 8:
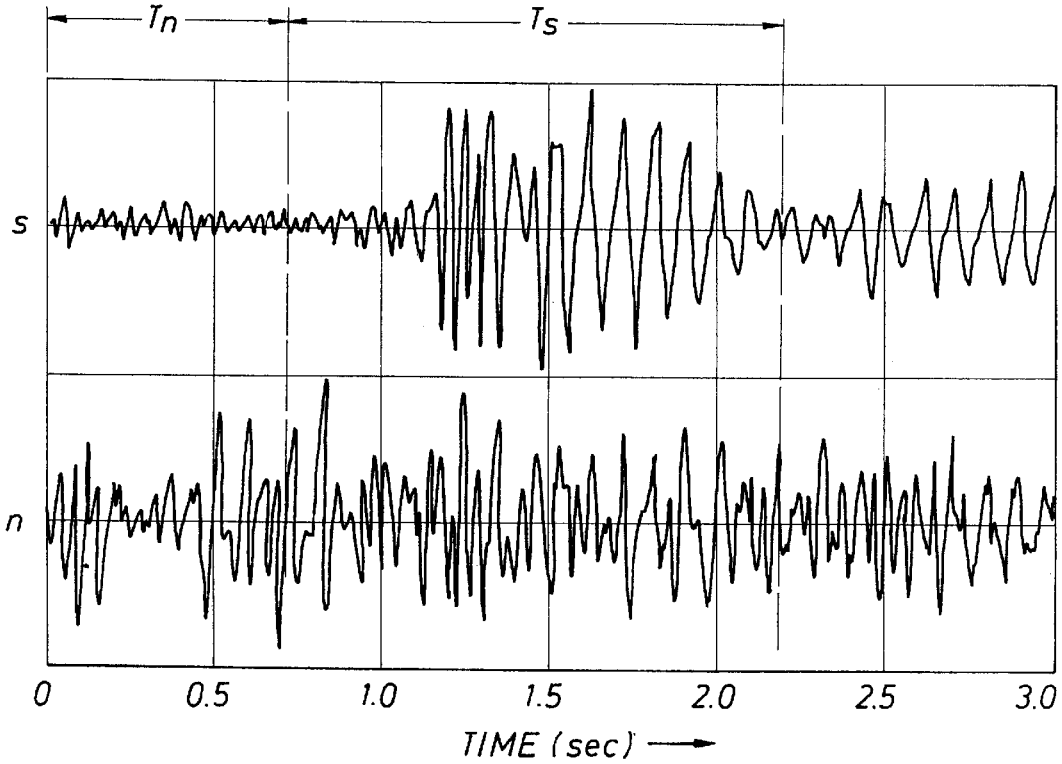
FIG. 8 is an example of signal and noise estimates according to the invention.

Still another aspect of the invention is based on signal and noise decomposition. It is assumed that each recording contains a true signal component and a noise component. According to this technique, the signal is estimated by taking the sum of the x and y traces and the noise is estimated by taking the difference between the x and y traces. FIG. 8 illustrates the results of these sum and difference calculations. The top signal s is the sum of the x and y traces and the bottom signal n is the difference between the x and y traces.

The signal and noise decomposition technique is refined by selecting a time window ($T_s$ in FIG. 8) within which a true signal is expected (it is known that some early part of the signal data waveform can not possibly have signal content because of the close synchronization of surface and downhole systems), by calculating the signal energy using equation (5) below, $$S = \frac{1}{T_s}\sum_{T_s} s^2 \tag{5}$$

by calculating a first noise energy using equation (6) below, $$N_1 = \frac{1}{T_s}\sum_{T_s} n^2 \tag{6}$$

and by finding a first probability of true signal content using equation (7) below, which is the ratio of true signal to true signal plus noise.

$$P_1 = \frac{S}{S + N_1} \tag{7}$$

The signal and noise decomposition technique, as well as any of the other techniques described above, is further enhanced by calculating the signal energy in the expected noise window $T_n$ as shown in equation (8) below.

$$N_2 = \frac{1}{T_n}\sum_{T_s} s^2 \tag{8}$$

With equations (5) and (8), a second probability of true signal content is calculated using equation (9) below.

$$P_2 = \frac{S}{S + N_2} \tag{9}$$

Those skilled in the art will appreciate that the overall probability of true signal content in the recordings is found by taking the product of $P_1$ and $P_2$. The method thus described may be used to compare two signal data waveforms at a time. As will be described in more detail below, the invention enables the comparison of multiple waveforms at a time.

Figure 4:
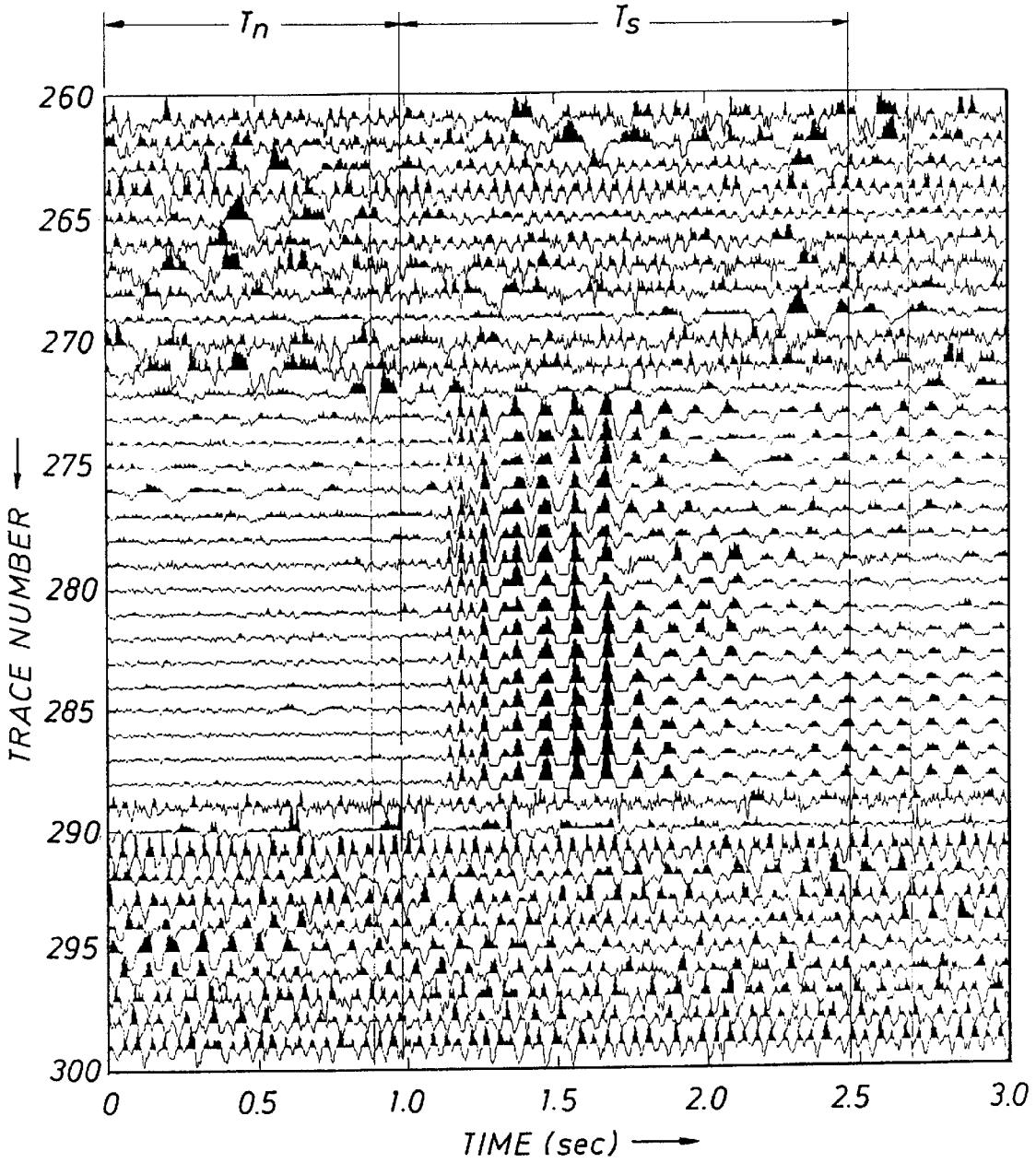
FIG. 4 is an example of selected signal data during a typical drilling operation showing traces with signal and noise according to the invention.
Figure 9:
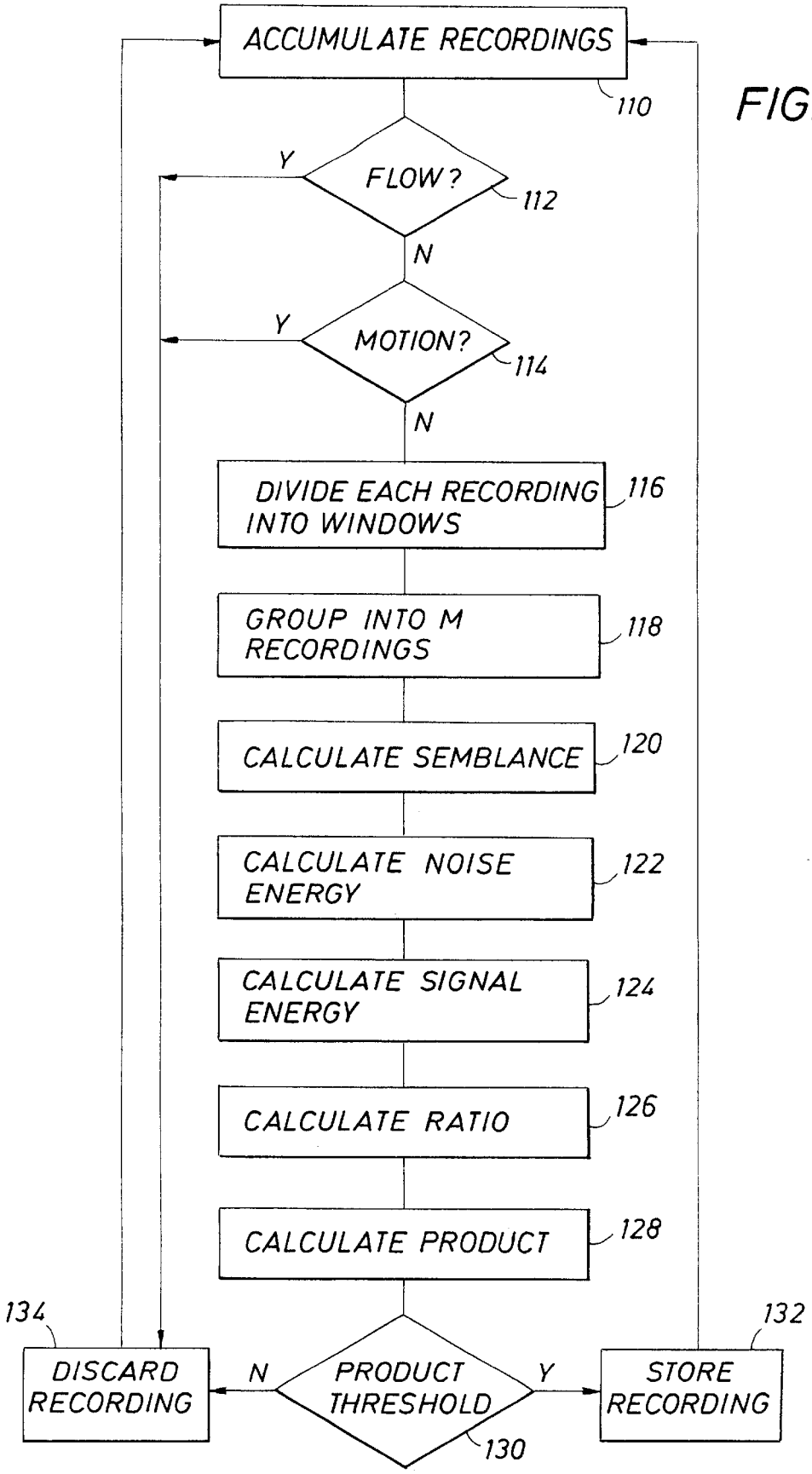
FIG. 9 is a flow chart of a method of the invention.

As shown in FIG. 9, a communication method of the invention begins with accumulation of recordings of signal data at 110. Signal data may be immediately discarded if sensors indicate mud flow at 112 or motion at 114. FIG. 4 illustrates a selection of signal data waveforms recorded in accord with the invention. In particular, FIG. 4 shows recordings numbered 260 through 300, each being a three second recording. Those skilled in the art will appreciate that recordings 260 through 272 and recordings 289 through 300 do not contain any true signal and are only noise. Recordings 273 through 288 clearly indicate that they contain true source signals. Because of the tight synchronization of the source and recorders (described above) it is known in this example that a true signal should not be detected until one second of recording. Similarly, the first one second of each recording should contain noise. After all of the recordings are accumulated (or after a sufficient number of recordings are accumulated), each recording is divided into two time windows $T_n$ (the first one second) and $T_s$ (the remainder of the recording) as shown at step 116 in FIG. 9. The following steps are performed for each sliding group of M recordings as indicated at 118 in FIG. 9.

As shown at 120 in FIG. 9, a calculation of semblance ($P_1$) is performed only in the $T_s$ windows with a sliding group of M number of traces according to equation (10). Further description of semblance calculations may be found in N. S. Neidall and M. T. Taner, Semblance and Other Coherency Measures for Multichannel Data, 34 GEOPHYSICS, 1971, 482–97.

$$P_1 = \frac{\sum_{T_s}\left(\sum_{i=1}^{M} x_i\right)^2}{M\sum_{i=1}^{M}\sum_{T_s} x_i^2} \tag{10}$$

The next step at 122 is to calculate the noise energy N* in the noise windows $T_n$ according to equation (11) and at 124 to calculate the signal energy S* in the true signal window $T_s$ according to equation (12), as shown below.

$$N^* = \frac{1}{T_n}\sum_{T_n}\left(\sum_{i=1}^{M} x_i\right)^2 \tag{11}$$

-continued $$S^* = \frac{1}{T_s}\sum_{T_s}\left(\sum_{i=1}^{M} x_i\right)^2 \tag{12}$$

The next step at 126 is to calculate the ratio of the true signal energy to true signal energy plus noise energy to obtain a second probability, as shown in equation (13), and then at 128 to calculate the product of $P_1$ and $P_2$.

$$P_2 = \frac{S^*}{S^* + N^*} \tag{13}$$

Figure 10:
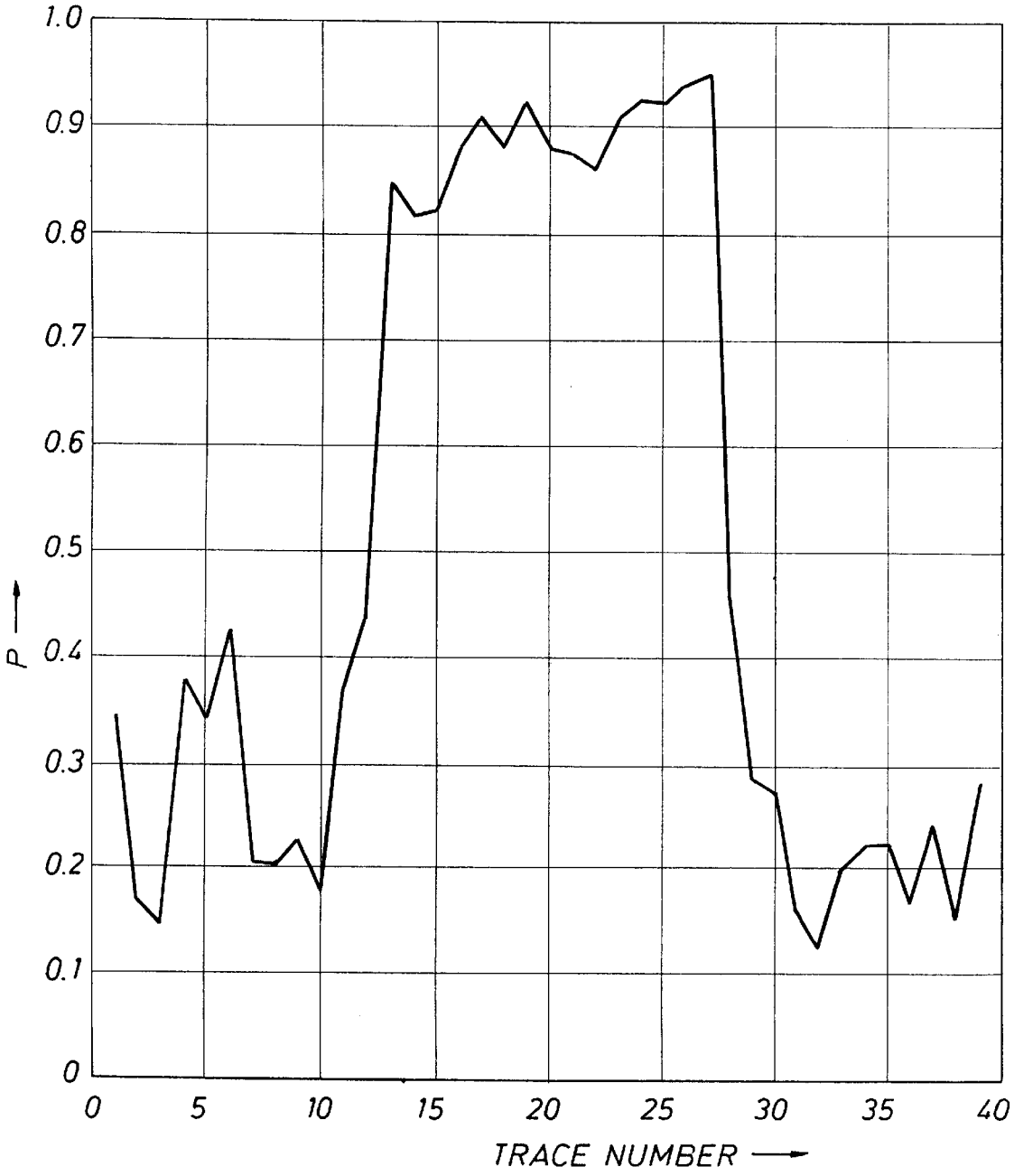
FIG. 10 is a graph of the probability calculations on the traces of FIG. 4 according to the invention.

FIG. 10 illustrates the product of $P_1$ and $P_2$ over the range of recordings shown in FIG. 4 where calculations were made using M=3 (i.e., calculations were made using a sliding group of three recordings at a time). The numbers on the X-axis in FIG. 10 correspond to the numbers on the Y-axis of FIG. 4, less 259, i.e., trace 260 in FIG. 4 corresponds to trace number 1 in FIG. 10. According to the invention, a predetermined threshold P value (e.g., 0.7) is used to decide, from the results pictured in FIG. 10, which of the records contain true source signals. As shown at 130 in FIG. 9, each obtained product is compared to the threshold. If it exceeds the threshold, the recording is stored at 132. If it does not exceed the threshold, the recording is discarded at 134.

Once it is determined which signal data records represent true source signals, specific processing may then be performed on the data representations (i.e., the waveforms) to prepare a response to be transmitted to the surface by MWD telemetry or by other modes as known in the art. Hence, the activation of the source 14 according to a predetermined schedule establishes basic communication that indicates to the downhole tool 40 that it should perform a specific action or process. As shown in FIG. 9, the algorithm operates in a loop, repeating as new signal data is acquired.

It will be appreciated by those skilled in the art having the benefit of this disclosure, that the communication techniques of the invention are not limited to any one particular type of signal transmission between uphole and downhole equipment. A system in accord with the invention may be implemented utilizing various means of signal generation/transmission, including seismic, EM telemetry, or pressure variations in the drill pipe.

There have been described and illustrated herein several embodiments of methods and apparatus for efficient communication with a downhole tool. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its scope as so claimed.

What is claimed is:

1. An apparatus for communication with a downhole tool, comprising:

an uphole signal source;

a programmable triggering system coupled to said uphole signal source;

an uphole clock coupled to said programmable triggering system;

a downhole receiver within the downhole tool;

downhole signal processing means coupled to said downhole receiver for processing signal data received by said receiver;

downhole memory coupled to said signal processing means; and a downhole clock coupled to said signal processing means, wherein said signal processing means includes means for recording signal data received by said receiver into said memory and comparison means for determining whether recorded signal data represents a true source signal.

2. The apparatus according to claim 1, wherein said uphole and downhole clocks are synchronized to each other.

3. The apparatus according to claim 1, wherein said signal source is a seismic source.

4. The apparatus according to claim 1, wherein said receiver is an acoustic receiver.

5. The apparatus according to claim 1, wherein said comparison means includes means for comparing sequentially recorded signal data for similarity.

6. The apparatus according to claim 1, further comprising a mud flow sensor coupled to said signal processing means such that said means for recording signal data only records signal data when said mud flow sensor indicates that mud flow is interrupted.

7. The apparatus according to claim 1, further comprising a motion sensor coupled to said signal processing means such that said means for recording signal data only records signal data when said motion sensor indicates that drilling is stopped.

8. The apparatus according to claim 1, wherein said comparison means includes segmenting means for segmenting the recorded signal data into multiple time windows.

9. The apparatus according to claim 8, wherein said comparison means includes means for extracting records from the time windows, wherein the lengths of the time windows are associated with a period of activation of the signal source.

10. The apparatus according to claim 8, wherein said time windows include a noise window in which no true source signal is expected to be found and a signal window in which a true source signal may be found.

11. The apparatus according to claim 10, wherein said comparison means includes semblance calculation means for performing a semblance calculation of the recorded signal data found in the signal window of the segmented recorded signal data.

12. The apparatus according to claim 11, wherein the semblance calculations are expressed as probabilities having values between zero and one.

13. The apparatus according to claim 10, wherein said comparison means includes noise energy calculation means for calculating the energy of the signal data found in the noise window of the segmented recorded signal data, and signal energy calculation means for calculating the energy of the signal data found in the signal window of the segmented recorded signal data.

14. The apparatus according to claim 13, wherein said comparison means includes quotient means for determining signal energy as a fractional part of signal energy plus noise energy, and product means for determining the probability of signal presence as a product of semblance calculations with quotient calculations.

15. The apparatus according to claim 1, wherein said comparison means includes correlation means for performing a correlation algorithm on the recorded signal data.

16. The apparatus according to claim 15, wherein said comparison means includes segmenting means for segmenting the correlated signal data into two time windows, a first time window being a noise window in which no true source signal is expected to be found and a second time window being a signal window in which a true source signal may be found.

17. The apparatus according to claim 16, wherein said comparison means includes RMS ratio calculating means for calculating the ratio of RMS amplitude in the two time windows.

18. The apparatus according to claim 1, wherein said comparison means includes coherence means for generating a coherence function for the recorded signal data.

19. The apparatus according to claim 18, wherein said comparison means includes averaging means for averaging the coherence function within a frequency band.

20. The apparatus according to claim 1, wherein said comparison means includes summing means for summing sequential signal data to create a sum waveform and difference means for calculating the difference between sequential signal data to create a difference waveform.

21. The apparatus according to claim 20, wherein said comparison means includes segmenting means for segmenting the sum waveform into two time windows, a first noise window in which no true source signal is expected to be found and a first signal window in which a true source signal may be found and for segmenting the difference waveform into two time windows, a second noise window in which no true source signal is expected to be found and a second signal window in which a true source signal may be found.

22. The apparatus according to claim 21, wherein said comparison means includes signal energy calculation means for calculating signal energy in the signal window and first noise energy calculation means for calculating noise energy in the signal window.

23. The apparatus according to claim 22, wherein said comparison means includes first probability means for calculation the quotient of signal energy over signal energy plus first noise energy as a first probability.

24. The apparatus according to claim 23, wherein said comparison means includes second noise energy calculation means for calculating noise energy in the noise window.

25. The apparatus according to claim 24, wherein said comparison means includes second probability means for calculation the quotient of signal energy over signal energy plus second noise energy as a second probability.

26. The apparatus according to claim 23, wherein said comparison means includes overall probability means for calculating the product of the first probability and the second probability.

27. A method for communication with a downhole tool, said method comprising:

a) firing an uphole signal source according to a schedule;

b) receiving signal data at the downhole tool according to the schedule;

c) comparing said signal data to each other to determine whether said signal data represents a true source signal; and d) processing the signal data which are determined to represent true source signals.

28. The method according to claim 27, wherein said step of comparing includes comparing sequential signal data for similarity.

29. The method according to claim 27, wherein said step of comparing includes stacking or averaging said signal data.

30. The method according to claim 27, wherein said step of comparing includes segmenting the signal data into multiple time windows.

31. The method according to claim 30, wherein said step of comparing includes extracting records from the time windows, wherein the lengths of the time windows are associated with the firing schedule of the signal source.

32. The method according to claim 30, wherein said time windows include a noise window in which no true source signal is expected to be found and a signal window in which a true source signal may be found.

33. The method according to claim 32, wherein said step of comparing includes performing a semblance calculation of sequential signal data found in the signal window of the segmented signal data.

34. The method according to claim 33, wherein the semblance calculations are expressed as probabilities having values between zero and one.

35. The method according to claim 32, wherein said step of comparing includes calculating the energy of the signal data found in the noise window of the segmented signal data, and calculating the energy of the signal data found in the signal window of the segmented signal data.

36. The method according to claim 35, wherein said step of comparing includes determining signal energy as a fractional part of signal energy plus noise energy, and determining the probability of signal presence as a product of semblance calculations with quotient calculations.

37. The method according to claim 27, further comprising recording the signal data when a mud flow sensor indicates that mud flow is interrupted.

38. The method according to claim 27, further comprising recording the signal data when a motion sensor indicates that drilling is stopped.

39. The method according to claim 27, wherein said step of comparing includes performing a correlation algorithm on sequential signal data to produce a correlated waveform.

40. The method according to claim 39, wherein said step of comparing includes segmenting the correlated waveform into two time windows, a first time window being a noise window in which no true source signal is expected to be found and a second time window being a signal window in which a true source signal may be found.

41. The method according to claim 40, wherein said step of comparing includes calculating the ratio of RMS amplitude in the two time windows.

42. The method according to claim 27, wherein said step of comparing includes generating a coherence function for sequential signal data.

43. The method according to claim 42, wherein said step of comparing includes averaging the coherence function within a frequency band.

44. The method according to claim 27, wherein said step of comparing includes summing sequential signal data to create a sum waveform and difference means for calculating the difference between sequential signal data to create a difference waveform.

45. The method according to claim 44, wherein said step of comparing includes segmenting the sum waveform into two time windows, a first noise window in which no true source signal is expected to be found and a first signal window in which a true source signal may be found and segmenting the difference waveform into two time windows, a second noise window in which no true source signal is expected to be found and a second signal window in which a true source signal may be found.

46. The method according to claim 45, wherein said step of comparing includes calculating signal energy in the signal window and first noise energy calculation means for calculating noise energy in the signal window.

47. The method according to claim 46, wherein said step of comparing includes calculating the quotient of signal energy over signal energy plus first noise energy as a first probability.

48. The method according to claim 47, wherein said step of comparing includes calculating noise energy in the noise windows.

49. The method according to claim 48, wherein said step of comparing includes calculating the quotient of signal energy over signal energy plus second noise energy as a second probability.

50. The method according to claim 49, wherein said comparison means includes overall probability means for calculating the product of the first probability and the second probability.

51. A method for communicating with a dowihole tool, comprising:

a) firing a signal source from a remote location;

b) receiving signal data associated with said signal at the downhole tool;

c) segmenting said signal data into events defined by a time period;

d) comparing said segmented signal data to determine whether said signal data represents a true source signal; and e) processing the signal data determined to represent a true source signal.

52. The method according to claim 51, wherein said step of segmenting includes segmenting said signal data into events defined by an equal time period associated with the firing of said signal source.

53. The method according to claim 51, wherein said step of processing includes determining a signal arrival time to said downhole tool.

54. The method according to claim 51, further comprising instructing said tool to perform an operation based on said processed signal data.

55. The method according to claim 51, further comprising sending some or all of said processed signal data to a surface location.

* * * * *